US011189120B2

(12) United States Patent
Amuduri et al.

(10) Patent No.: US 11,189,120 B2
(45) Date of Patent: Nov. 30, 2021

(54) SHARING STATE INFORMATION OF AN AUXILIARY DOOR

(71) Applicant: Carrier Corporation, Palm Beach Gardens, FL (US)

(72) Inventors: Santhosh Amuduri, Telengana (IN); Subhash Reddy Gopavaram, Telengana (IN); Srinivasa Rao Veeravalli, Telengana (IN); Adam Kuenzi, Silverton, OR (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/248,791

(22) Filed: Feb. 8, 2021

(65) Prior Publication Data

US 2021/0264704 A1 Aug. 26, 2021

(30) Foreign Application Priority Data

Feb. 26, 2020 (IN) ..... 202011008189

(51) Int. Cl.
*G07C 9/00* (2020.01)

(52) U.S. Cl.
CPC . *G07C 9/00309* (2013.01); *G07C 2009/0019* (2013.01)

(58) Field of Classification Search
CPC ..... G07C 9/00309; G07C 2009/0019; G07C 9/38; G07C 9/00571; G07C 9/00174; G07C 9/00904; G07C 9/27; G07C 2209/65; G07C 2209/62
USPC ..... 340/5.61
See application file for complete search history.

(56) References Cited

U.S. PATENT DOCUMENTS 6,891,479 B1 * 5/2005 Eccleston ..... E05F 15/63 116/86
6,970,084 B2 * 11/2005 Kwon ..... E05B 63/0056 340/542
6,998,977 B2 * 2/2006 Gregori ..... G07C 3/00 340/505
8,269,627 B2 * 9/2012 Gore ..... G08B 25/008 340/547
8,456,305 B2 * 6/2013 Gates ..... G08B 25/009 340/542
8,653,962 B2 * 2/2014 Maeng ..... G08B 25/007 340/539.1
9,672,727 B1 * 6/2017 Alexander ..... G08B 25/14
9,725,927 B1 * 8/2017 Cheng ..... H04N 7/186
9,804,596 B1 * 10/2017 Slavin ..... A01K 11/008
(Continued)

*Primary Examiner* — Nam V Nguyen
(74) *Attorney, Agent, or Firm* — James A. Edwards

(57) ABSTRACT

A system and method for sharing state information of an auxiliary door are provided. The system includes a main locking device and an auxiliary door with a state sensor. The state sensor is configured to detect and transmit state information to at least one of the main locking device and a room management system. The state information may include whether the auxiliary door is in an opened state, a closed state, a locked state, and/or an unlocked state. The main locking device is configured to transmit a notification based on the state information when a rotation sensor detects the rotation of an interior door handle and the state information indicates that the auxiliary door is in the opened state and/or the unlocked state. This notification may be sent to a mobile device and/or a status indicator.

20 Claims, 4 Drawing Sheets

(56) References Cited

U.S. PATENT DOCUMENTS

| | | | | |
|---|---|---|---|---|
| 10,015,653 | B2 | 7/2018 | Corporation | |
| 10,047,543 | B2 * | 8/2018 | Yurasits | E05B 1/00 |
| 10,096,187 | B2 * | 10/2018 | Deneen | E05F 15/77 |
| 10,228,266 | B1 * | 3/2019 | McGruder | E05B 65/0841 |
| 10,390,079 | B2 | 8/2019 | Inc. | |
| 10,443,266 | B2 * | 10/2019 | Johnson | G08B 13/1966 |
| 10,494,836 | B2 | 12/2019 | Company | |
| 2014/0062466 | A1 * | 3/2014 | Thibault | G01B 7/14 324/207.22 |
| 2019/0234110 | A1 * | 8/2019 | Laporta | E05B 7/00 |

* cited by examiner

SHARING STATE INFORMATION OF AN AUXILIARY DOOR

CROSS REFERENCE TO A RELATED APPLICATION

The application claims the benefit of India Provisional Application No. 202011008189 filed Feb. 26, 2020, the contents of which are hereby incorporated in their entirety.

BACKGROUND

Locking devices (e.g., those used in hotels, apartment buildings, office buildings, classrooms, cruise ships, laboratories, and similar structures) can be used to limit access to a particular environment. For example, hotels may use locking devices to limit access to only authorized guests.

To gain access to a hotel room, a guest must present valid credentials to a locking device on a main door. These credentials may be presented using an RFID card, a card with a magnetic stripe, and/or a mobile device. Once these credentials are authorized by the locking device the door is unlocked and the guest can enter the room. Depending on the design and configuration of the room, the room may have multiple auxiliary doors. One example of an auxiliary door is a door to a balcony. Guests commonly open the door to the balcony to allow fresh air to flow into the hotel room. Traditionally these balcony doors have a fairly simplistic latching mechanism to allow the guest to secure the room. However, when guests leave the room, they often forget to close and lock the door to the balcony. This can present a security risk both for the guest, and for the operation of the hotel, as an intruder may come in through the open and/or unlocked door.

Accordingly, there remains a need for a system to share state information of an auxiliary door so that the guest can be informed that the auxiliary door is in an open and/or unlocked state.

BRIEF DESCRIPTION

According to one embodiment, a system for sharing state information of an auxiliary door is provided. The system includes a main locking device and an auxiliary door with a state sensor. The main locking device includes a communication module configured to receive state information, and an interior door handle with a rotation sensor. The communication module is configured to transmit a notification based on the state information. The rotation sensor of the interior door handle is configured to detect the rotation of the interior door handle. The rotation sensor is communicatively connected with the communication module. The state sensor of the auxiliary door is configured to detect state information. The state information includes at least one of: an opened state, a closed state, a locked state, and an unlocked state of the auxiliary door. The state sensor is communicatively connected to transmit the state information to at least one of: a main locking device and a room management system. The communication module transmits the notification when the rotation sensor detects the rotation of the interior door handle and the state information includes at least one of: the opened state and the unlocked state.

In accordance with additional or alternative embodiments, the state sensor is communicatively connected with the communication module of the main locking device to transmit the state information from the state sensor to the communication module.

In accordance with additional or alternative embodiments, the state sensor is communicatively connected with a room management system to transmit the state information from the state sensor to the room management system, the room management system communicatively connected with the communication module of the main locking device to transmit the state information from the room management system to the communication module.

In accordance with additional or alternative embodiments, the communication module transmits the notification to a mobile device, the notification including the state information of the auxiliary door.

In accordance with additional or alternative embodiments, the communication module transmits the notification to a status indicator, the status indicator signaling when the state information includes at least one of: the opened state and the unlocked state.

In accordance with additional or alternative embodiments, the status indicator is located on the main locking device.

In accordance with additional or alternative embodiments, the signaling by the status indicator includes at least one of: an audible sound, a visual light, and an electronic graphical or character display.

In accordance with additional or alternative embodiments, the state sensor includes at least one reed switch and at least one magnet.

In accordance with additional or alternative embodiments, the notification is transmitted using at least one of: Wi-Fi, Bluetooth, Bluetooth Low Energy (BTLE), Zigbee, infrared, and cellular.

In accordance with additional or alternative embodiments, the state information is transmitted using at least one of: Wi-Fi, Bluetooth, Bluetooth Low Energy (BTLE), Zigbee, infrared, and cellular.

According to another aspect of the disclosure, a method of sharing state information of an auxiliary door is provided. The method includes detecting state information with a state sensor of an auxiliary door, the state information including at least one of: an opened state, a closed state, a locked state, and an unlocked state of the auxiliary door. The method additionally includes transmitting the state information from the state sensor of the auxiliary door to at least one of: a main locking device and a room management system. The method further includes transmitting a notification from a communication module of a main locking device when a rotation sensor detects the rotation of an interior door handle and the state information includes at least one of: the opened state and the unlocked state.

In accordance with additional or alternative embodiments, the state sensor is communicatively connected with the communication module of the main locking device to transmit the state information from the state sensor to the communication module.

In accordance with additional or alternative embodiments, the state sensor is communicatively connected with a room management system to transmit the state information from the state sensor to the room management system, the room management system communicatively connected with the communication module of the main locking device to transmit the state information from the room management system to the communication module.

In accordance with additional or alternative embodiments, the communication module transmits the notification to a mobile device, the notification including the state information of the auxiliary door.

In accordance with additional or alternative embodiments, the communication module transmits the notification to a status indicator, the status indicator signaling when the state information includes at least one of: the opened state and the unlocked state.

In accordance with additional or alternative embodiments, the status indicator is located on the main locking device.

In accordance with additional or alternative embodiments, the signaling by the status indicator includes at least one of: an audible sound, a visual light, and an electronic graphical or character display.

In accordance with additional or alternative embodiments, the state sensor includes at least one reed switch and at least one magnet.

In accordance with additional or alternative embodiments, the notification is transmitted using at least one of: Wi-Fi, Bluetooth, Bluetooth Low Energy (BTLE), Zigbee, infrared, and cellular.

In accordance with additional or alternative embodiments, the state information is transmitted using at least one of: Wi-Fi, Bluetooth, Bluetooth Low Energy (BTLE), Zigbee, infrared, and cellular.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

Any room (e.g., for a hotel, apartment, office, classroom, cruise ship, laboratory, etc.) may include a main door and one or more auxiliary doors. The main door may be viewed to be any door with a main locking device configured to limit access to the particular room. The auxiliary door(s) may be viewed to be any door that is accessible once the guest has entered the room (e.g., a balcony door, a door linking adjacent rooms, etc.). The main locking device on the main door may be configured to require the guest to present valid credentials to enter the room. Depending on the design and configuration of the room, there may be only one main door. However, it is envisioned that there may be instances where there are multiple main doors, each of which may include their own locking device.

To gain access to the room, the guest may present credentials using an RFID card, a card with a magnetic stripe, and/or a mobile device. Once the guest is in the room they may be able to unlock and/or open the one or more auxiliary doors. When leaving, the guest may exit through a main door, which may automatically lock behind the guest. To help inform the guest that an auxiliary door is in an open and/or unlocked state when leaving the room, a system to share state information of an auxiliary door is provided.

Figure 1:
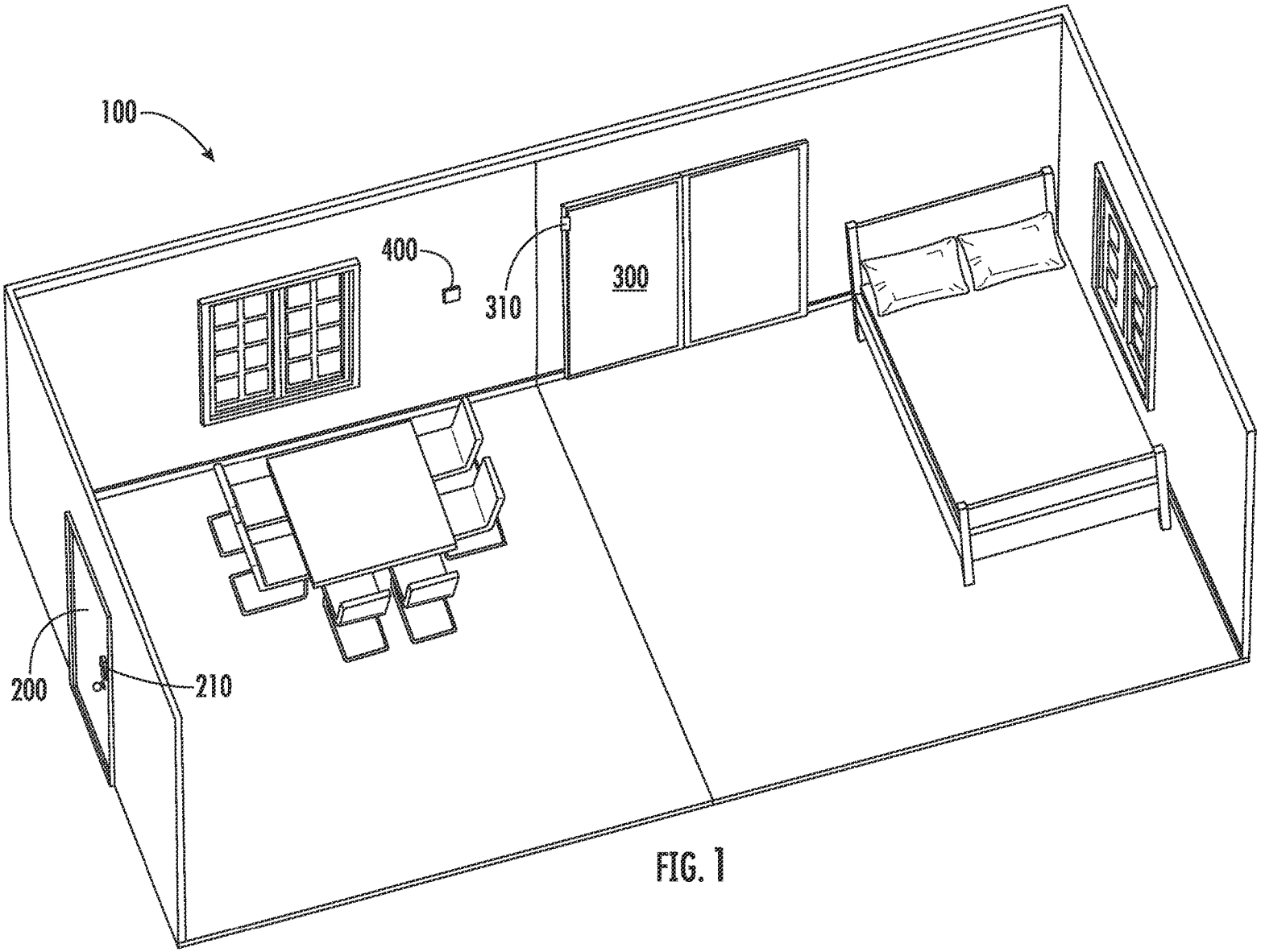
FIG. 1 is a perspective view of a system for sharing state information of an auxiliary door in accordance with one aspect of the disclosure.

With reference now to the Figures, a perspective view of a system 100 for sharing state information of an auxiliary door 300 is shown in FIG. 1. This system 100 may be incorporated within any room (e.g., hotel room, apartment, office, classroom, cabin on a cruise ship, laboratory, etc.), however, for purposes of clarity and brevity, the system 100 has only been depicted within a hotel room. As shown in FIG. 1, the hotel room includes a main door 200 with a main locking device 210 and an auxiliary door 300 with a state sensor 310. Although not depicted, it is envisioned that the system 100 may include multiple main doors 200 and/or multiple auxiliary doors 300. It being envisioned that state information from multiple auxiliary doors 300 may be transmitted to one or more main door 200. In certain instances, each auxiliary door 300 includes a state sensor 310. Each state sensor 310 is configured to detect state information (e.g., whether an auxiliary door 300 is in an opened state, closed state, a locked state, and/or an unlocked state) of an auxiliary door 300. Each state sensor 310 may be communicatively connected to transmit the state information, which may help inform a guest that an auxiliary door 300 is in an open and/or unlocked state.

Each state sensor 310 may, in certain instances, include at least one reed switch and at least one magnet to detect the state information of an auxiliary door 300. The reed switch may include a set of electrical connectors placed slightly apart. When a magnetic field (e.g., created by the at least one magnet) is placed in parallel to the electrical connectors, the electrical connectors are pulled together, closing the circuit. When incorporating a reed switch and a magnet, the state sensor 310 may detect that the auxiliary door is opened 300 when the reed switch and the magnet are disconnected from one another. The state sensor 310 may, in certain instances, be configured to transmit state information either when the electrical connectors are pulled together, or open, depending on the configuration of the system 100. Although each state sensor 310 has been described to potentially include at least one reed switch and at least one magnet, it is envisioned that each state sensor 310 may include any suitable sensor capable of detecting state information (e.g., capable of detecting whether an auxiliary door 300 is closed, opened, locked, and/or unlocked). In certain instances, each auxiliary door 300 may include multiple state sensors 310.

Figure 2:
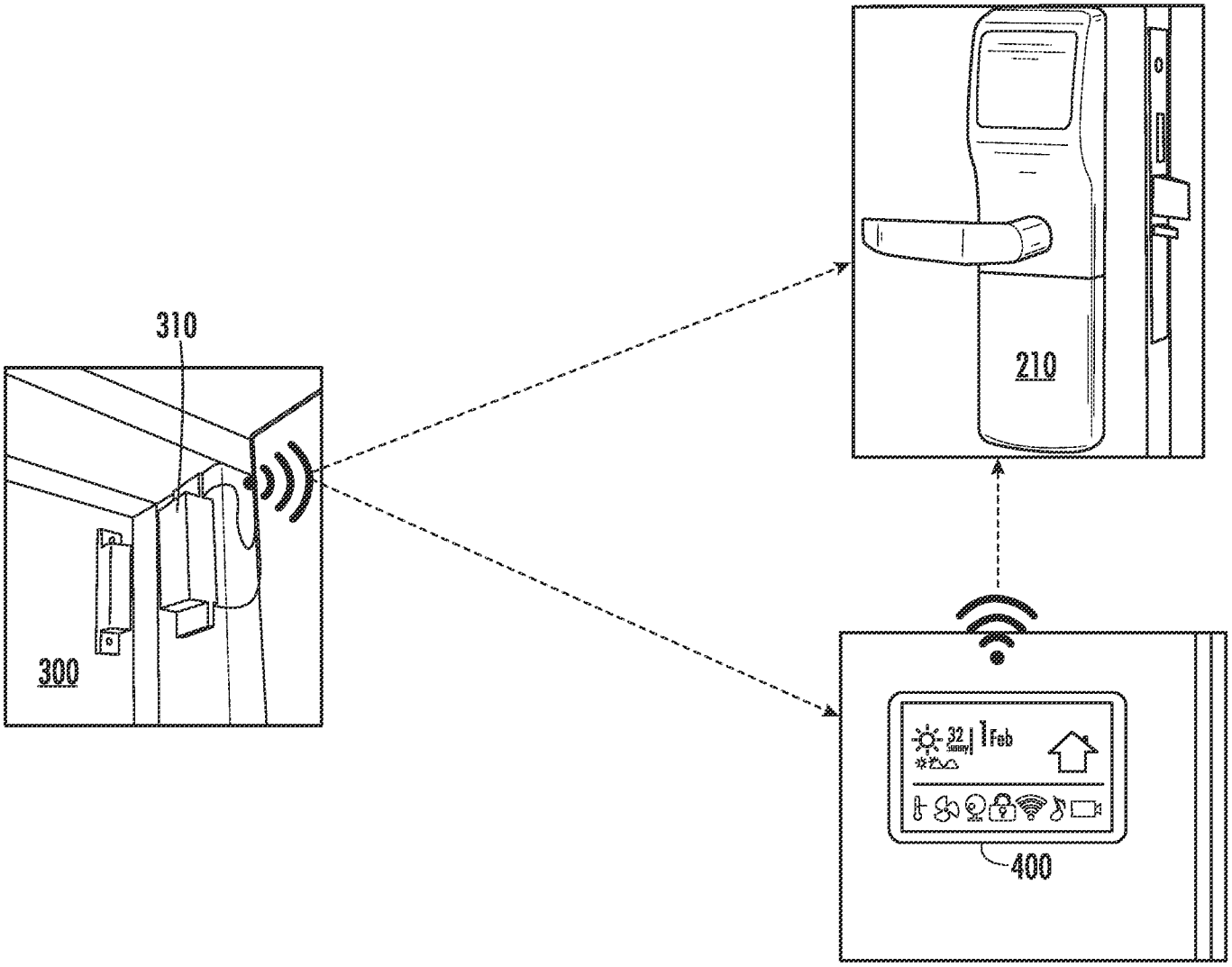
FIG. 2 is a schematic illustration of an auxiliary door with a state sensor, a main locking device, and a room management system in accordance with one aspect of the disclosure.

As shown in FIG. 2, the state sensor 310 of an auxiliary door 300 may be communicatively connected to transmit the state information to at least one of: a main locking device 210 and a room management system 400. The transmission of the state information to the main locking device 210 and/or the room management system 400 may be completed using any suitable form of communication (e.g., using one or more wired connection, Wi-Fi, Bluetooth, Bluetooth Low Energy (BTLE), Zigbee, infrared, cellular or any other short-range or long-range wireless communication method known to one skilled in the art). When transmitting the state information to the main locking device 210, the state sensor 310 may be communicatively connected with a communication module 211 of the main locking device 210. When transmitting the state information to the room management system 400, the state sensor 310 may be communicatively connected with the room management system 400 and the room management system 400 may be communicatively connected with the communication module 211 of the main locking device 210 to transmit the state information from the room management system 400 to the communication module 211 of the main locking device 210.

Figure 3:
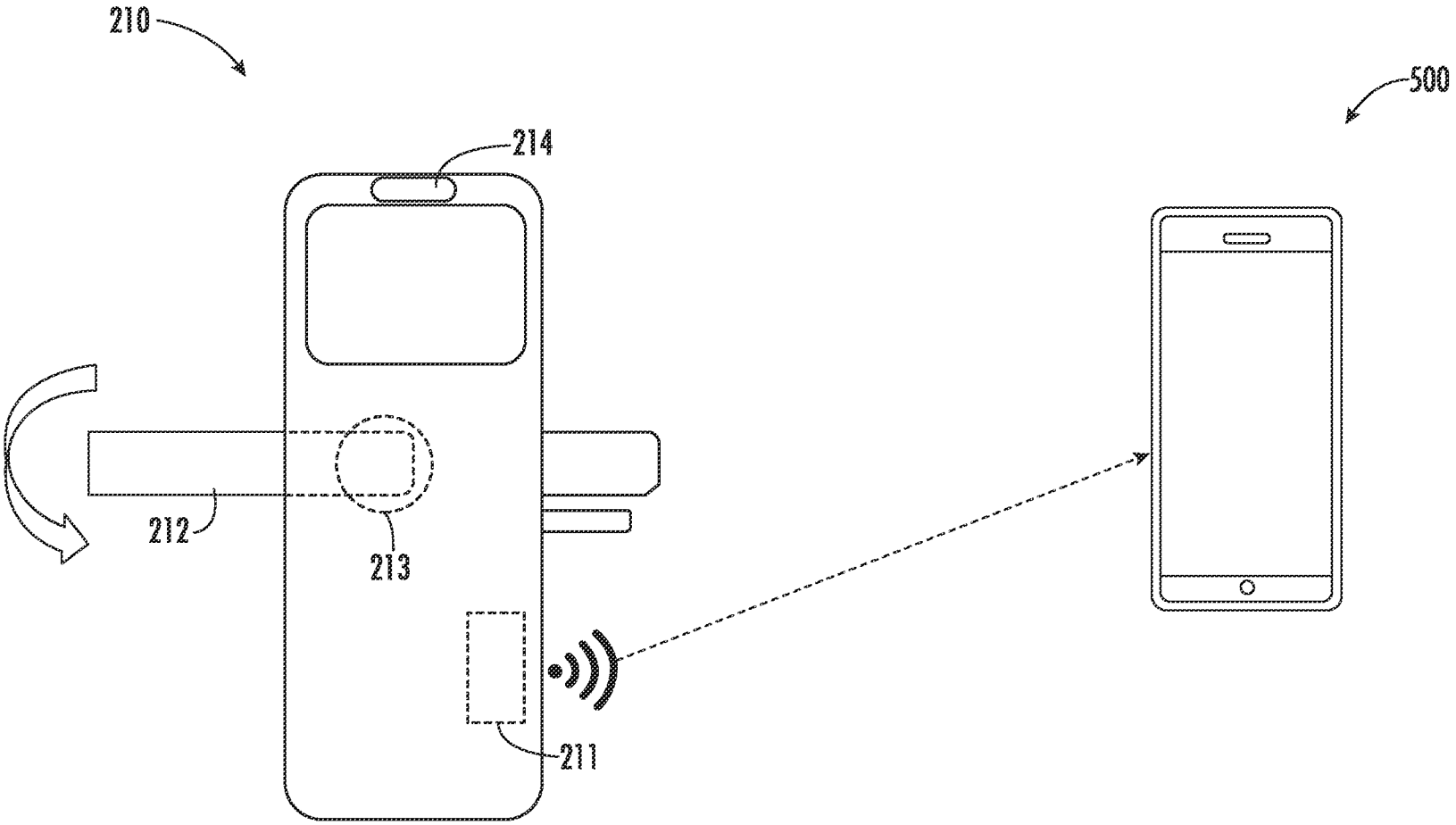
FIG. 3 is a schematic illustration of a main locking device with a status indicator, and a mobile device in accordance with one aspect of the disclosure.

Regardless of whether the state information is transmitted from the state sensor 310 to the room management system 400 or directly to the main locking device 210, the communication module 211 of the main locking device 210 is configured to transmit a notification when the interior door handle 212 is rotated and the state information indicates that an auxiliary door 300 is in at least one of an opened state and an unlocked state. A schematic illustration of a main locking device 210 transmitting a notification is shown in FIG. 3. As shown in FIG. 3, the main locking device 210 includes a communication module 211 and an interior door handle 212. The communication module 211 is configured to receive state information (e.g., directly from a state sensor 310 and/or from a room management system 400). The communication module 211 is also configured to transmit a notification based on the state information (e.g., from the communication module 211 to a mobile device 500 and/or to a status indicator 214). In certain instances, the notification is transmitted from the communication device 211 to the mobile device 500 over a Bluetooth Low Energy (BTLE) connection between the communication module 211 and the mobile device 500. The interior door handle 212 may include a rotation sensor 213 configured to detect the rotation of the interior door handle 212. The rotation sensor 213 may be communicatively connected (e.g., using one or more wired connection and/or using one or more form of wireless communication) with the communication module 211. The rotation sensor 213, by detecting the rotation of the interior door handle 212, may inform the main locking device 210 that the guest is leaving the room. The communication module 211 may transmit the notification when the rotation sensor 213 detects the rotation of the interior door handle 212 and the state information indicates that an auxiliary door 300 is in an opened state and/or unlocked state.

In certain instances, it may be beneficial, even when the auxiliary door 300 is closed, to inform the guest that the auxiliary door 300 is in an unlocked state, because the guest may assume that because the auxiliary door 300 is closed, it is also locked. It may also be beneficial to inform the guest that the auxiliary door 300 is open, even when the auxiliary door 300 is locked, because the lock may be in a locked position even when the auxiliary door 300 is not fully closed. Additionally, it may also be beneficial, even when the auxiliary door 300 both open and unlocked, to inform the guest of the state information of the auxiliary door 300 because the auxiliary door 300 may be out of the guest's sightline when they are leaving the room. Each of these situations, when the auxiliary door 300 is left opened and/or unlocked, may present a security risk both to the guest of the room, and to the operation of the hotel. It is envisioned that by transmitting a notification when the guest is leaving the room, a guest will be informed of the current state of an auxiliary door 300, which may prompt the guest to close and/or lock the auxiliary door 300.

To inform the guest as to the current state of an auxiliary door 300, in certain instances, the communication module 211 may transmit the notification to a mobile device 500. This notification, in certain instances, may appear in the form of a text message and/or visual message on the screen of the mobile device 500. This notification may be transmitted using any suitable form of communication (e.g., using Wi-Fi, Bluetooth, Bluetooth Low Energy (BTLE), Zigbee, infrared, cellular or any other short-range or long-range wireless communication method known to one skilled in the art). In addition to, or in replacement of, transmitting the notification to a mobile device 500, the communication module 211 may transmit the notification to a status indicator 214. As with the transmission of the notification to the mobile device, the transmission of the notification to a signal indicator 214 may be completed using any suitable form of communication (e.g., using one or more wired connection, Wi-Fi, Bluetooth, Bluetooth Low Energy (BTLE), Zigbee, infrared, cellular or any other short-range or long-range wireless communication method known to one skilled in the art).

When the system 100 includes multiple auxiliary doors 300, the notification (e.g., the notification transmitted to the mobile device 500 and/or to the status indicator 214) may indicate to the guest which particular auxiliary door 300 is in the opened and/or unlocked state. For example, the text message and/or visual message on the screen of the mobile device 500 may depict which auxiliary door 300 is opened and/or unlocked. The status indicator 214 may signal (e.g., as an audible sound, a visual light, and/or an electronic graphical or character display) when the state information indicates that an auxiliary door 300 is in an opened and/or unlocked state. In certain instances, the status indicator 214 is located on the main locking device 210 (e.g., as a light emitting diode (LED) or a screen disposed on the exterior surface of the main locking device 210). When the system 100 includes multiple auxiliary doors 300, the status indicator 214 may indicate to the guest which particular auxiliary door 300 is in the opened and/or unlocked state. For example, the status indicator 214 may present different signals (e.g., different visual patterns and/or audible sounds) for different auxiliary doors 300 (e.g., the visual patterns and/or audible sounds may be different for an auxiliary door 300 to the balcony than the visual patterns and/or audible sounds for an auxiliary door 300 to an adjacent room). In certain instances, the different visual patterns presented by the status indicator 214 may be in the form of different electronic graphical or character displays being made (e.g., on a screen). The electronic graphical or character displays may be in the form of images, text, or video being presented (e.g., "auxiliary door #1 opened" or "auxiliary door #2 unlocked") by the status indicator 214.

The different signals (e.g., different colored lights, different frequency of blinking, different frequency of buzzing, different frequency of beeping, and/or different electronic graphical or character displays) made by the status indicator 214 may be triggered, in certain instances, by sending different voltages to the status indicator 214 (e.g., sent through a wired connection from the communication module 211). It is envisioned that, regardless of the type of signal made by the status indicator 214, the signaling may inform a guest that an auxiliary door 300 is in an unlocked and/or opened state. In certain instances, signal made by the status indicator 214 may continue for a defined period of time, for example, between five (5) seconds and five (5) minutes following the rotation of the interior door handle 212.

Additionally, in certain instances, the system 100 may be configured to enable the request of state information from the main locking device 210 after the signaling has stopped. For example, after the status indicator 214 has stopped signaling, a guest may request state information (e.g., by presenting valid credentials to the main locking device 210) from the main locking device 210. This request of state information may be cause the status indicator 214 to restart the signaling of the state information, for example, continue signaling for a defined period of time (e.g., between five (5) seconds and five (5) minutes). This may allow a guest to check the state information of the auxiliary door(s) 300 after the status indicator 214 has stopped signaling.

Figure 4:
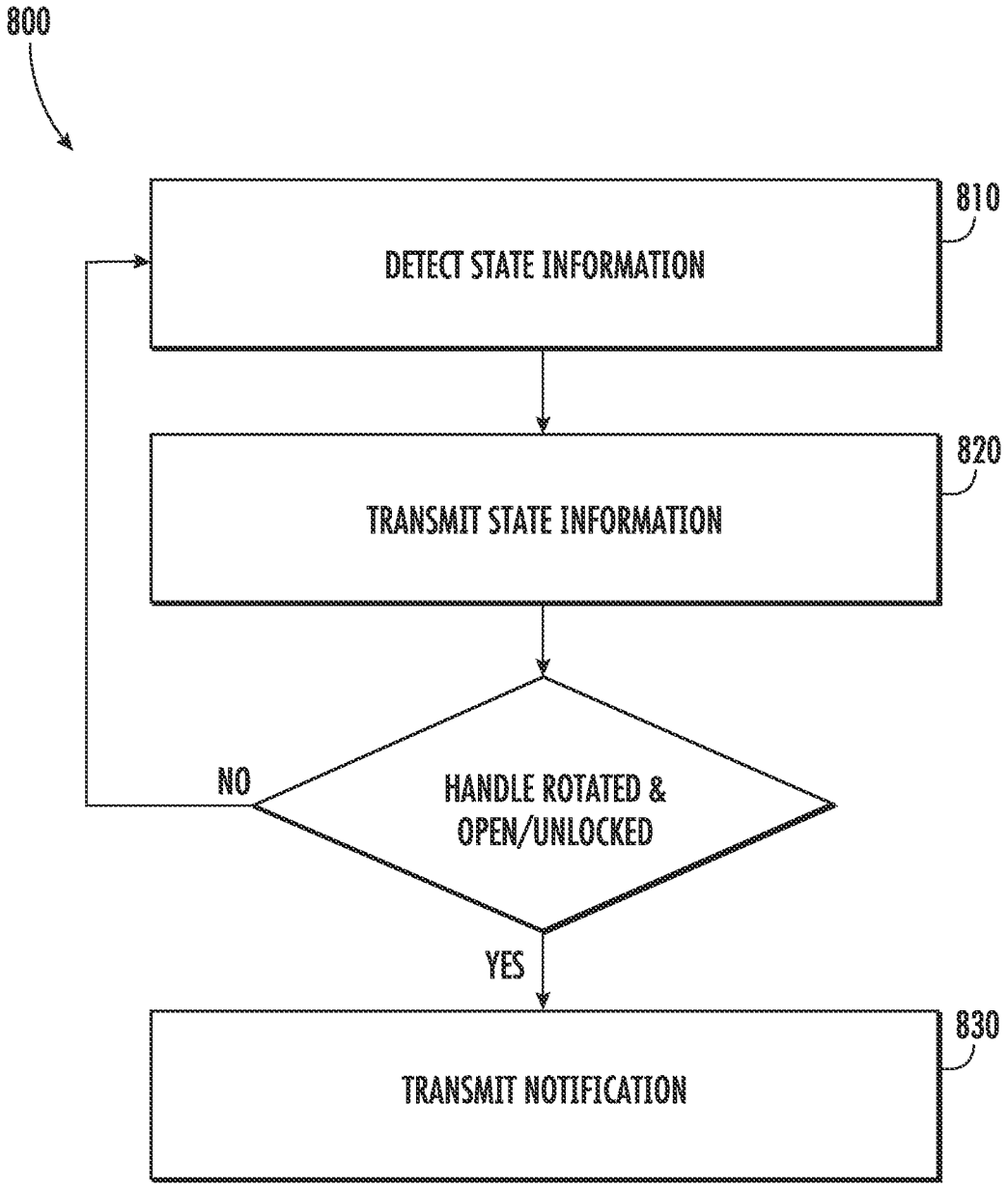
FIG. 4 is a flow diagram illustrating a method for sharing state information of an auxiliary door in accordance with one aspect of the disclosure.

The system 100, by detecting and transmitting the state information of one or more auxiliary door(s) 300 to a main locking device 210, may enable a method of sharing state information of one or more auxiliary door(s) 300 within a room (e.g., a hotel room) with a guest anytime the guest leaves the room. The method of sharing state information of an auxiliary door 300 is illustrated in FIG. 4. As shown in FIG. 4, the method 800 includes step 810 of detecting state information with a state sensor 310 of an auxiliary door 300, the state information including at least one of: an opened state, a closed state, a locked state, and an unlocked state of the auxiliary door 300. The method 800 further includes step 820 of transmitting the state information from the state sensor 310 of the auxiliary door 300 to at least one of: a main locking device 210 and a room management system 400. In certain instances, the state sensor 310 is communicatively connected with the communication module 211 of the main locking device 210 to transmit the state information from the state sensor 310 to the communication module 211. In certain instances, the state sensor 310 is communicatively connected with the room management system 400 to transmit the state information from the state sensor 310 to the room management system 400. The room management system 400 may be communicatively connected with the communication module 211 of the main locking device 210 to transmit the state information from the room management system 400 to the communication module 211 of the main locking device 210.

The method 800 additionally includes step 830 of transmitting a notification from the communication module 211 of the main locking device 210 when a rotation sensor 213 detects the rotation of an interior door handle 212 and the state information indicates the auxiliary door 300 is in an opened state and/or an unlocked state. This notification may be transmitted to a mobile device 500 and/or a status indicator 214. Regardless of whether the notification is sent to a mobile device 500 and/or a status indicator 214, it is envisioned that the notification will help inform the guest that an auxiliary door 300 is in an open and/or unlocked state when leaving the room, which may, in certain instances, prompt the guest to close and/or lock the auxiliary door 300.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for sharing state information of an auxiliary door, the system comprising:

a main locking device comprising:

a communication module configured to receive state information, the communication module configured to transmit a notification based on the state information;

an interior door handle comprising a rotation sensor, the rotation sensor configured to detect the rotation of the interior door handle, the rotation sensor communicatively connected with the communication module; and the auxiliary door comprising:

a state sensor configured to detect state information, the state information comprising at least one of: an opened state, a closed state, a locked state, and an unlocked state of the auxiliary door, the state sensor communicatively connected to transmit the state information to at least one of: the main locking device and a room management system;

wherein the communication module transmits the notification when the rotation sensor detects a rotation of the interior door handle and the state information comprises at least one of: the opened state and the unlocked state.

2. The system of claim 1, wherein the state sensor is communicatively connected with the communication module of the main locking device to transmit the state information from the state sensor to the communication module.

3. The system of claim 1, wherein the state sensor is communicatively connected with a room management system to transmit the state information from the state sensor to the room management system, the room management system communicatively connected with the communication module of the main locking device to transmit the state information from the room management system to the communication module.

4. The system of claim 1, wherein the communication module transmits the notification to a mobile device, the notification comprising the state information of the auxiliary door.

5. The system of claim 1, wherein the communication module transmits the notification to a status indicator, the status indicator signaling when the state information comprises at least one of: the opened state and the unlocked state.

6. The system of claim 5, wherein the status indicator is located on the main locking device.

7. The system of claim 5, wherein the signaling by the status indicator comprises at least one of: an audible sound, a visual light, and an electronic graphical or character display.

8. The system of claim 1, wherein the state sensor comprises at least one reed switch and at least one magnet.

9. The system of claim 1, wherein the notification is transmitted using at least one of: Wi-Fi, Bluetooth, Bluetooth Low Energy (BTLE), Zigbee, infrared, and cellular.

10. The system of claim 1, wherein the state information is transmitted using at least one of: Wi-Fi, Bluetooth, Bluetooth Low Energy (BTLE), Zigbee, infrared, and cellular.

11. A method of sharing state information of an auxiliary door, the method comprising:

detecting state information with a state sensor of auxiliary door, the state information comprising at least one of: an opened state, a closed state, a locked state, and an unlocked state of the auxiliary door;

transmitting the state information from the state sensor of the auxiliary door to at least one of: a main locking device and a room management system;

transmitting a notification from a communication module of a main locking device when a rotation sensor detects a rotation of an interior door handle and the state information comprises at least one of: the opened state and the unlocked state.

12. The method of claim 11, wherein the state sensor is communicatively connected with the communication module of the main locking device to transmit the state information from the state sensor to the communication module.

13. The method of claim 11, wherein the state sensor is communicatively connected with a room management system to transmit the state information from the state sensor to the room management system, the room management system communicatively connected with the communication module of the main locking device to transmit the state information from the room management system to the communication module.

14. The method of claim 11, wherein the communication module transmits the notification to a mobile device, the notification comprising the state information of the auxiliary door.

15. The method of claim 11, wherein the communication module transmits the notification to a status indicator, the status indicator signaling when the state information comprises at least one of: the opened state and the unlocked state.

16. The method of claim 15, wherein the status indicator is located on the main locking device.

17. The method of claim 15, wherein the signaling by the status indicator comprises at least one of: an audible sound, a visual light, and an electronic graphical or character display.

18. The method of claim 11, wherein the state sensor comprises at least one reed switch and at least one magnet.

19. The method of claim 11, wherein the notification is transmitted using at least one of: Wi-Fi, Bluetooth, Bluetooth Low Energy (BTLE), Zigbee, infrared, and cellular.

20. The method of claim 11, wherein the state information is transmitted using at least one of: Wi-Fi, Bluetooth, Bluetooth Low Energy (BTLE), Zigbee, infrared, and cellular.

* * * * *